United States Patent [19]

Sadler

[11] Patent Number: 5,009,379

[45] Date of Patent: Apr. 23, 1991

[54] BED MOUNTED TELEVISION STAND

[76] Inventor: Thomas E. Sadler, 1250 First St., NW., Cedar Rapids, Iowa 52405

[21] Appl. No.: 541,371

[22] Filed: Jun. 21, 1990

[51] Int. Cl.[5] ..... A47B 23/00

[52] U.S. Cl. ..... 248/174; 5/507; 108/49

[58] Field of Search ..... 248/174; 108/13, 49; 5/503, 507

[56] References Cited

U.S. PATENT DOCUMENTS

| | | | |
|---|---|---|---|
| D. 163,627 | 6/1951 | Paterniti | 5/507 X |
| 1,588,914 | 6/1926 | Smith | 108/49 X |
| 1,930,882 | 10/1933 | McRae | 5/507 X |
| 4,465,255 | 8/1984 | Hill | 5/507 |
| 4,691,396 | 9/1987 | Hoffman | 5/503 X |
| 4,724,555 | 2/1988 | Poehner et al. | 5/507 X |
| 4,819,568 | 4/1989 | Coffrin | 108/13 X |

*Primary Examiner*—David L. Talbott

*Attorney, Agent, or Firm*—James C. Nemmers

[57] ABSTRACT

A stand for supporting a television receiver or other large object at the end of a conventional bed or waterbed. The stand is a very simple, preferably one-piece unit that has a lower base which fits under the mattress, which base is joined to an upper ledge that supports the television receiver. No assembly of the stand is necessary, and no fasteners are required to attach the stand to the bed.

6 Claims, 1 Drawing Sheet

FIG. 1
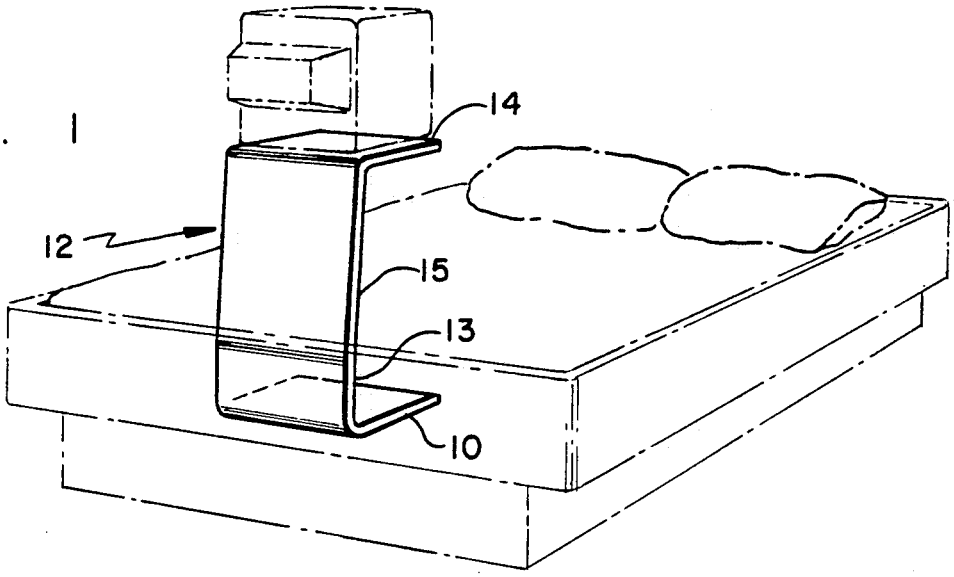
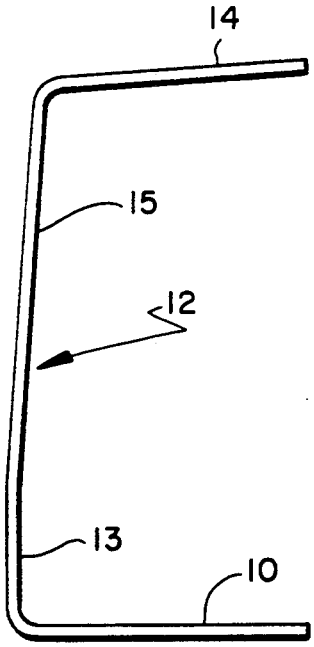
FIG. 2
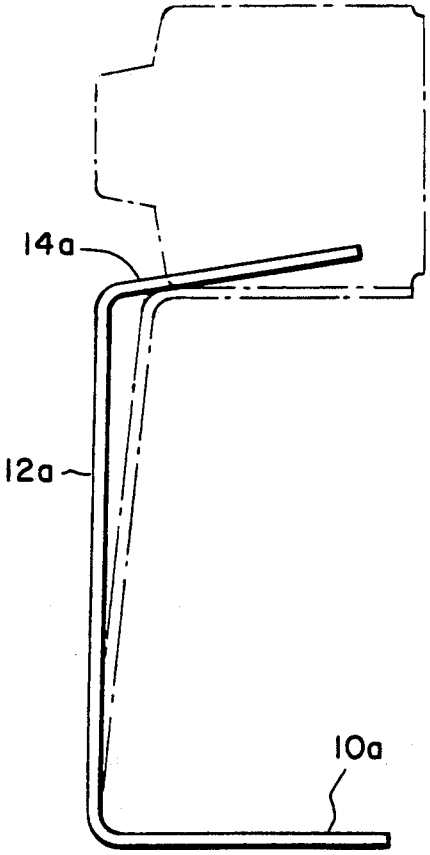
FIG. 3

BED MOUNTED TELEVISION STAND

BACKGROUND OF THE INVENTION

Many households in the country now have more than one television set, and frequently, a second television set is found in the bedroom. However, bedrooms are not normally equipped with the type of furniture for supporting a television set, and frequently, the bedrooms are sufficiently small that the addition of another piece of furniture in the form of a television stand is not desirable. Moreover, most individuals who watch television in a bedroom watch while lying down in the bed, and thus the television set must be supported at a sufficiently high level to facilitate comfortable viewing.

Although the prior art shows a variety of television stands, some of which are useful in bedrooms, all the stands are relatively complex and require fasteners, mounting brackets or other adaptors in order to properly secure the stand to the bed. An example of such a stand is that shown in Lindenmuth, U.S. Pat. No. 3,358,957 which shows a stand that uses brackets and fasteners to secure the stand to the bed. Similarly, Maffei, U.S.Pat. No. 4,410,158 shows a support frame for a television receiver which also uses clamping devices.

There is therefore a need for a simple, inexpensive support for a television receiver that can be easily and quickly installed with no assembly or fasteners required to properly support a television receiver for comfortable viewing from a bed. Obviously, any such support stand should also not detract from the decor of the bedroom, and the stand should be useable with any type of bed, either conventional or a waterbed, and regardless of the bed frame.

SUMMARY OF THE INVENTION

The television receiver support stand of the invention, in its preferred embodiment, is a simple one-piece stand that has a lower base that is positioned beneath the mattress and the mattress supporting frame. A vertical member extends upwardly from the lower base to an upper ledge that supports the television receiver. By extending the upper ledge forwardly in the same direction as the lower base, and by assuring that the vertical member will be at a slight forward angle, the weight of the television receiver will provide the necessary force to assure that the stand remains firmly and safely in place.

BRIEF DESCRIPTION OF THE DRAWINGS

FIG. 1 is a perspective view of a stand constructed according to the principles of the invention and showing the stand in place on a bed, which is illustrated in broken lines along with the television receiver;

FIG. 2 is a side elevational view of a first embodiment of the stand; and

FIG. 3 is a side elevational view of another embodiment of the invention showing in broken lines the position of the stand when supporting a television receiver.

DESCRIPTION OF THE PREFERRED EMBODIMENTS OF THE INVENTION

The stand of the invention has a lower base 10 that extends horizontally and is preferably of a relatively large width so as to provide a sufficiently large surface area to distribute the forces due to the weight of the television over a relatively large area. The lower base 10 is preferably smooth, flat and of uniform thickness so that it can be positioned beneath a mattress and between the mattress and the supporting frame of the bed upon which it rests, especially when the stand of the invention is used in connection with a waterbed. A bed is shown in broken lines in FIG. 1 to illustrate how the stand of the invention is positioned relative to the bed, it being understood that the lower base 10 of the stand is positioned beneath the mattress.

Extending upwardly from the lower base 10 is a vertical member 12. As best seen in FIG. 2, the lower portion 13 of vertical member 12 is at approximately a right angle to the lower base 10, but the upper portion 15 of the vertical member 12 is at a slight angle, preferably not exceeding five degrees from the vertical. As will be evident from the further description of the stand, this assures that the force exerted by the weight of the television receiver will always be a downward force tending to force the lower base 10 downwardly.

At the upper end of the vertical member 12 is a horizontal ledge 14 that serves as the support for the television receiver. If desired, this horizontal ledge 14 may be provided with slots or any other suitable means to assist in positioning, holding or securing the television receiver in place on the ledge 14.

Both the vertical member 12 and the horizontal ledge 14 are of approximately the same width as the lower base 10. If they are not of the same width, the lower base 10 preferably should be wider than the vertical member 12 and upper ledge 14. Also, the length of the lower base 10 should be at least as long as the length of the upper ledge 14.

The preferred embodiment of the support stand of the invention shown in the drawing is preferably made of a single piece of a suitable material such as an acrylic plastic material. If desired, the stand can be made of round metal tubing, with the tubes being spaced apart a suitable width and formed in continuous lengths to provide a horizontal lower base, a vertical member and a horizontal upper ledge. If tubing is used, the upper ledge 14 would be formed by securing in any suitable manner a flat smooth piece of suitable material, such as wood or plastic, to the tubes forming the upper ledge. In either event, the material used in making the stand should be capable of supporting the television receiver on the upper ledge without any significant bending, since it is preferred that the upper ledge 14 remain substantially horizontal even when the television receiver is being supported.

In FIG. 3 there is illustrated an embodiment of the invention in which the stand is formed form a single piece of acrylic plastic material that has a limited amount of flexibility. As seen in FIG. 3, when the stand is not supporting a television receiver, the vertical member **12*a* is substantially at a right angle to the lower base 10*a*, and the upper ledge 14*a* extends slightly upwardly from the horizontal approximately nine degrees. Because of the inherent flexibility of the material used, when a television receiver weighing between 25 and 40 pounds is placed on the upper ledge 14*a*, the weight of the receiver will bend the upper ledge 14*a* downwardly to a substantially horizontal position with the vertical member 12*a* at a slight angle to the vertical in the direction of the lower base 10*a* and upper ledge 14*a*. This is illustrated in broken lines in FIG. 3**.

In any of the embodiments, whether the stand is made of plastic, wood, metal, tubing, or whether it is made of rigid or some material of limited flexibility, it is important that when the television receiver is being supported on the upper ledge, that the upper ledge be substantially horizontal and parallel with the lower base 10. It is also important that the vertical member 12 be at a slight angle, preferably not more than five degrees, from the vertical member. In this manner, the weight of the television receiver on the upper ledge 14 will create a downward force that will tend to force the lower base downwardly, thus aiding in keeping the stand securely in place against the frame of the bed that supports the mattress. It is also preferable that the lower base 10 extend outwardly from the vertical member 12 at least as far as the upper ledge 14.

From the foregoing description, it will be evident that the support stand of the invention requires no assembly to secure it to the bed, and the stand installs easily without the use of any brackets or other fasteners. Because the lower base is positioned between the bottom of the mattress and the supporting frame of the bed, it will remain securely in place, and the weight of the television will in fact aid in maintaining the support stand in place. Because it requires no mounting brackets or fasteners, use of the supporting stand of the invention will not in any way damage the bed. It can be quickly and easily installed and removed, and supports the television receiver at a comfortable viewing height.

Having thus described the invention in connection with certain preferred embodiments thereof, it will be evident to those skilled in the art that various revisions and modifications can be made to the preferred embodiments disclosed herein without departing from the spirit and scope of the invention. It is my intention, however, that all such revisions and modifications as are obvious to those skilled in the art will be included within the scope of the following claims.

What is claimed is as follows:

1. A stand for supporting a television receiver or the like on a bed having a mattress separable from and supported on a suitable support means forming part of the bed, said stand comprising a lower horizontally extending base having an inner end and an outer end, the outer end of the base being insertable between the mattress and its support means so as to position the base therebetween, an upright member extending upwardly from the inner end of the base, and an upper ledge for supporting a television receiver and having an inner end jointed to the upper end of the upright member, the upper ledge being of a sufficient width to accommodate a television receiver and extending substantially horizontally outwardly toward an outer edge spaced from the inner edge a sufficient distance for the ledge to support a television receiver, the upright member being at an acute angle from the vertical toward the outer edge of the ledge so as to create a force that biases the lower base downwardly toward the support means of the bed when a television receiver is supported on the upper ledge.

2. The stand of claim 1 in which upper ledge extends outwardly away from the upright member a distance beyond that of the lower base.

3. The stand of claim 1 in which the lower base is of a width at least as great as the upper ledge.

4. The stand of claim 1 in which the upright member has a lower portion joined to the base at substantially a right angle and an upper portion joined to the upper ledge, the upper portion extends upwardly from the lower portion and is at an angle of less than five degrees from the plane of the lower portion, and the base, upright member and upper ledge are rigidly joined so that the upper ledge will always be substantially parallel to the base even when a television receiver is being supported by the stand.

5. The stand of claim 1 in which the lower base, upright member and upper ledge are of a none-piece construction.

6. The stand of claim 5 in which the base, upright member and upper ledge are of a material that has limited flexibility so that the upright member is substantially vertical and the upper ledge is at a slight angle upwardly from the horizontal when the stand is not supporting a television receiver, but when supporting a television receiver the upright member is at a slight angle from the vertical toward the outer edge of the upper ledge and the upper ledge is substantially horizontal and parallel to the base.

* * * * *